US007311273B2

(12) United States Patent
Agneray et al.

(10) Patent No.: US 7,311,273 B2
(45) Date of Patent: Dec. 25, 2007

(54) FLUID INJECTION DEVICE

(75) Inventors: Andre Agneray, Boulogne Billancourt (FR); Laurent Levin, Paris (FR)

(73) Assignee: Renault s.a.s., Boulogne Billancourt (FR)

( * ) Notice: Subject to any disclaimer, the term of this patent is extended or adjusted under 35 U.S.C. 154(b) by 141 days.

(21) Appl. No.: 10/555,327

(22) PCT Filed: May 7, 2004

(86) PCT No.: PCT/FR2004/001118

§ 371 (c)(1),
(2), (4) Date: Nov. 2, 2005

(87) PCT Pub. No.: WO2004/101985

PCT Pub. Date: Nov. 25, 2004

(65) Prior Publication Data

US 2006/0278735 A1 Dec. 14, 2006

(30) Foreign Application Priority Data

May 9, 2003 (FR) ..... 03 05622

(51) Int. Cl.

| | |
|---|---|
| ***F02M 61/08*** | (2006.01) |
| ***F02M 61/10*** | (2006.01) |
| ***F02M 61/20*** | (2006.01) |
| ***F02M 51/00*** | (2006.01) |
| ***F02M 61/00*** | (2006.01) |
| ***F02M 63/00*** | (2006.01) |
| ***B05B 1/08*** | (2006.01) |

(52) U.S. Cl. ..... 239/533.7; 239/102.2; 239/533.2; 239/533.9; 239/585.1; 239/585.5

(58) Field of Classification Search ..... 239/533.7, 239/102.2, 533.2, 533.9, 585.1, 585.5, 533.3, 239/533.4, 533.5, 533.11, 533.13, 584, 585.2, 239/585.3, 585.4; 251/129.06
See application file for complete search history.

(56) References Cited

U.S. PATENT DOCUMENTS

| | | | | |
|---|---|---|---|---|
| 2,721,100 | A | 10/1955 | Bodine, Jr. | |
| 4,907,748 | A * | 3/1990 | Gardner et al. | 239/584 |
| 6,279,842 | B1 * | 8/2001 | Spain | 239/585.1 |
| 6,467,460 | B1 | 10/2002 | Stier | |
| 6,584,958 | B2 * | 7/2003 | Rahardja et al. | 123/467 |
| 6,758,408 | B2 * | 7/2004 | Czimmek | 239/5 |
| 6,840,459 | B1 * | 1/2005 | Ruehle et al. | 239/102.2 |

FOREIGN PATENT DOCUMENTS

| | | |
|---|---|---|
| EP | 1 172 552 | 1/2002 |
| FR | 2 816 008 | 5/2002 |
| WO | WO 0063553 A1 * | 10/2000 |
| WO | WO 0235086 A1 * | 5/2002 |

* cited by examiner

*Primary Examiner*—Darren Gorman
(74) *Attorney, Agent, or Firm*—Oblon, Spivak, McClelland, Maier & Neustadt, P.C.

(57) ABSTRACT

A fluid injection device including a protruding needle. One end of the needle forms a valve and can be moved between a closed position, in which the valve seals the fluid-release opening, and an open position, in which the valve is positioned at a controlled distance from the opening. Movement of the valve between the closed position and the open position is produced by the controlled intrinsic extension of the protruding needle.

17 Claims, 3 Drawing Sheets

FLUID INJECTION DEVICE

The present invention relates to a fluid-injection device.

BACKGROUND OF THE INVENTION

1. Field of the Invention

The invention can be applied particularly advantageously in the automotive field, especially as regards the injection of fuel into a combustion chamber.

2. Description of Related Art

From the prior art there is known a first type of injection devices designated as recessed needles. In this traditional configuration, each injector is provided with a jet needle that is capable of being displaced axially. This mobility exists between a closed position, in which the distal end of the jet needle blocks an aperture intended for ejection of the fluid, and an open position, in which the said distal end is positioned at a distance from this same aperture.

It must also be noted that it is immaterial whether the aperture comprises a single orifice or a plurality of holes arranged downstream from the seat, which is intended to cooperate sealingly with the distal end of the jet needle. This latter configuration proves particularly adapted to the injection of liquid, since the presence of orifices in large numbers is of such nature as to perturb the ejection of the liquid and consequently to multiply the droplets.

Be that as it may, this type of recessed-needle injector suffers from the disadvantage that it functions almost by the all-or-nothing principle. In other words, the needle tip either allows a maximum quantity of pressurized fluid to pass, or it prevents it from escaping via the aperture. Thus the parameters for adjustment of such a system are essentially limited to the fluid pressure and to the discharge cross section of the aperture.

In actual practice, and especially in the case in which the fluid is a liquid, a recessed-needle injector almost always functions at constant pressure. Thus it is the diameter of the holes that will determine the size of the droplets. Since the dimensions of the holes in question are fixed by design, however, it appears to be particularly difficult to modify the droplet size at all. Even if the recessed needle is opened and closed very rapidly, the perturbation then created will be very largely insufficient to generate a mist of small diffuse droplets effectively.

Thus, with an injection device of the recessed-needle type, it is certainly possible to control the quantity of fluid injected, but from all evidence it is not conceivable that the size and diffusion of droplets can be controlled precisely. As is well known, this constitutes a major drawback in terms of efficiency.

Another important parameter to be controlled concerns the minimum quantity that it is possible to inject. As it happens, in a large proportion of recessed-needle injectors, the fluid overpressure is used to move the jet needle from its closed position to its open position. The response time of the system then depends on the magnitude of the pressure in question. In practice, it is necessary to raise the fluid pressure if it is desired to shorten the opening time of the recessed needle, but then the minimum quantities injected are increased. This constitutes a further disadvantage for this type of system.

A second type of prior art injection devices, designated as protruding needles, makes it possible to alleviate these difficulties. Here, each injector is provided with a kind of valve composed of a stem, one end of which forms a poppet and is capable of cooperating by leaktight contact with a seat defining a fluid-ejection aperture. As in the preceding case, the poppet stem formed in this way is mounted to be mobile by axial displacement between a closed position, in which the poppet blocks the aperture, and an open position, in which the said poppet is positioned at a distance from the said aperture.

The mobility of such a poppet stem is generally achieved by using either a piezoelectric actuator or a magnetostrictive actuator. Specifically, this consists in coupling the poppet stem of the injector with an appended element advantageously composed of a material known as active, meaning capable of changing shape, and especially of growing longer, when either an electric current or a magnetic field respectively is passed through it. Since the corresponding physical principles and the modes of operation of such actuators are fully known, they will not be further described here. It will be recalled simply that the assembly is generally arranged in such a way that excitation of the active material, electrical or magnetic respectively, causes elongation of the appended element and consequently a displacement of the poppet stem in its entirety. The distal end of the poppet stem is then no longer in contact with its seat, so that the fluid under pressure can then escape via the aperture.

Compared with their recessed-needle homologs, the protruding-needle injectors have the advantage of being able to have a variable lift at the poppet level. At constant pressure, therefore, it is possible to have a discharge cross section that is variable in time. For example, in the case of a piezoelectric actuator, a given elongation of the active material will be obtained as a function of the voltage applied to the appended element. The corresponding elongation of the appended element then causes a proportional displacement of the poppet stem, and consequently an equally proportional lift of the poppet.

Nevertheless, the injection devices of the protruding-needle type suffer from disadvantages that are peculiar to them.

With an appended element of piezoelectric material, it is possible to achieve deformations on the order of one thousandth, or in other words approximately 10 μm of displacement per 10 mm of piezoelectric stack. That means that the appended element must be extremely long if it is wished to obtain a poppet displacement of traditionally 50 μm. That then implies the need to charge very large capacitances, on the order of 3 to 3.5 μF, for a 30-mm stack, for example. Consequently, electronics of considerable power are needed if it is wished to shorten the switching time.

In addition, during operation of the protruding-needle injector, the great length of the appended element then constitutes a disadvantage in terms of weight. The assembly composed of the poppet stem, of the appended element and of other means for elastic return, then constitutes a relatively large mobile mass. The resulting significant inertia will then retard the responsiveness of the piezoelectric material even more.

Thus, by reason essentially of the large capacitances to be charged and of the large mass to be displaced, the injection devices having protruding needles and piezoelectric actuators prove to be intrinsically limited in terms of response time.

With an appended element of magnetostrictive material, it is essentially the problem of system inertia that constitutes the main handicap. After all, it must not be forgotten that the mobile mass being displaced is very large with prior art injection devices, since it corresponds to the combined masses of the stem, which is often long, and of the associated poppet.

BRIEF SUMMARY OF THE INVENTION

The technical problem to be solved by the object of the present invention is therefore to provide a fluid-injection device having a protruding needle, one end of which forms a poppet and is capable of being displaced in controlled manner at any instant between a closed position, in which the poppet blocks an aperture intended for ejection of the fluid, and an open position, in which the said poppet is positioned at a chosen distance from the said aperture, which injection device could make it possible to avoid the problems of the prior art by offering in particular substantially improved response times, or in other words substantially shorter opening and closing times of the poppet, as well as a variable opening capacity.

According to the present invention, the solution to the technical problem posed consists in the fact that the displacement of the poppet between its closed position and its open position is generated by an intrinsic elongation of the protruding needle.

In contrast to the prior art injection devices, what takes place here is not the displacement of the protruding needle in its entirety but the longitudinal deformation thereof in such a way as to generate a consequent displacement of its free end, or in other words the one carrying the poppet. The assembly is arranged in such a way that the mobility of the poppet exists between the previously defined closed position and open position, the mobility being controlled at every instant.

The invention defined in this way has the advantage of permitting a considerable reduction of the mobile mass and therefore a proportional decrease of the system inertia. Consequently, the response times of this type of injection devices are significantly improved.

The present invention also relates to the characteristics that will become apparent during the description hereinafter and that will have to be considered individually or in all of their possible technical combinations.

BRIEF DESCRIPTION OF THE DRAWINGS

This description, given by way of non-limitative example, will provide a better understanding of how the invention can be implemented, with reference to the attached drawings, wherein.

DETAILED DESCRIPTION OF THE INVENTION

For reasons of clarity, like elements have been designated by identical references. Similarly, only those elements essential for understanding the invention have been illustrated, albeit not to scale and in schematic manner.

Figure 1:
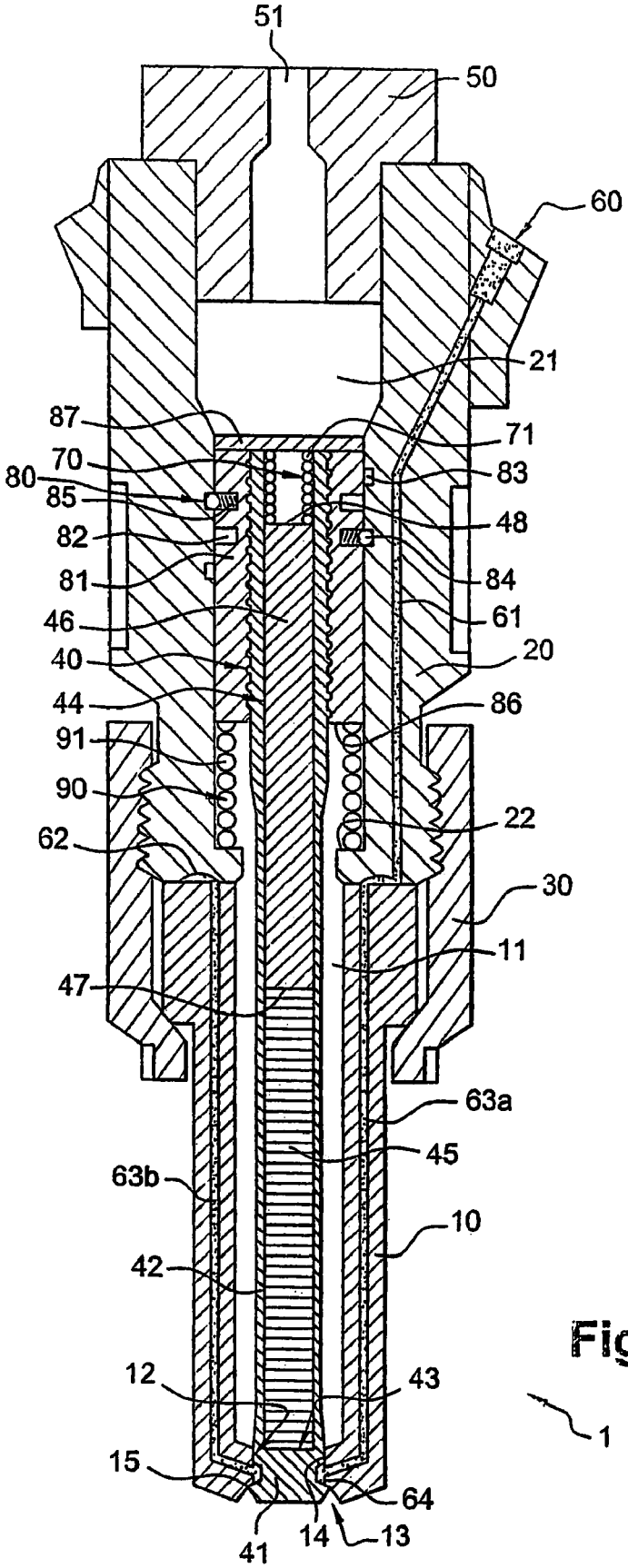
FIG. 1 illustrates a fluid-injection device according to a first embodiment of the invention.

FIG. 1 illustrates an injection device 1 intended to distribute a liquid fuel into a combustion chamber of a motor-vehicle engine.

In this particular embodiment, chosen solely by way of example, injection device 1 is composed mainly of three parts. Firstly there is distinguished a first casing 10, in which there is axially arranged a first bore 11. Then there is noted the existence of a second casing 20, which itself is provided with a second bore 21. These two casings 1o, 20 are sealingly interlocked by the intermediary of a coupling nut 30, whose operation is reversible. The assembly is arranged in such a way that first bore 11 and second bore 21 are in communication. The combination of the two casings 10, 20 then forms the body of injection device 1. Finally there is noted the presence of a protruding needle 40, which is disposed in the continuous space defined by bores 11, 21.

According to this FIG. 1, the distal end of protruding needle 40 is conformed in such a way that it is able to cooperate with a traversing hole 12 that is arranged in the lower part of first casing 10 and that defines an aperture 13 intended for ejection of the liquid. The distal end of protruding needle 40, forming a poppet 41, is more precisely capable of cooperating on the one hand, by sliding contact with a guide surface 14 arranged at the internal end of traversing hole 12 and, on the other hand, by sealing contact with a seat 15, which in turn is arranged at the external end of the said traversing hole 12. Be that as it may, poppet 41 is capable of being displaced between a closed position in which it blocks aperture 13, and an open position in which it is positioned at a distance from the said aperture 13.

It is also noted in FIG. 1 that the upper part of second bore 21 cooperates with an inserted and abutting closure cover 50, which is provided with a recirculation duct 51 for the liquid under pressure.

In addition, there is noted the presence of a supply system 60 for liquid under high pressure. This is provided with a main duct 61, which is arranged longitudinally in the thickness of second casing 20 and which communicates with an intermediate duct 62 extending at right angles to the axis of injection device 1, at the interface of second casing 20 and first casing 10. The annular form and the positioning of intermediate duct 62 make it possible to distribute the liquid under pressure into a plurality of secondary ducts 63*a*, 63*b*, which are regularly distributed in the thickness of first casing 10 and which connect into an annular cavity 64. This annular cavity 64, traditionally arranged between poppet 41 and traversing hole 12, has a shape, layout and function that are fully known and that therefore will not be further described here. It will be stipulated simply that the assembly is conformed in such a manner that it can generate and regulate, in traditional manner, a continuous circulation of liquid toward internal bores 11, 21 of injection device 1.

According to the object of the present invention, the displacement of poppet 41 between its closed position and its open position is advantageously generated here by an intrinsic elongation of protruding needle 40.

According to a particular feature of the invention, the intrinsic elongation of protruding needle 40 takes place up to the direct vicinity of poppet 41, or in other words at the level in particular of that part of the said protruding needle 40 which is situated directly in proximity to the said poppet 41.

It is in fact particularly advantageous that the deformation takes place as close as possible to the poppet, in order to minimize as well as possible the mobile mass to be displaced, which ideally should be limited to that of poppet 41. With such a configuration, the opening and closing times are consequently shortened in considerable proportions.

According to another particular feature of the invention, protruding needle 40 is provided with a hollow stem 42 having a solid end 43 that forms a poppet 41, as well as with an internal bar 44 composed of an active element 45 integral with a rear element 46, forming an inertial mass. Furthermore, this internal bar 44 is mounted to be mobile axially inside hollow stem 42, in the sense that it is interlocked only at the level of solid end 43, via active element 45. Thus active element 45 is mobile by means of axial elongation, while the rear element in turn is mobile by means of axial displacement. The junction zone between active element 45 and rear element 46 has the form of an interface 47.

It is to be noted that, throughout this text, the notion of active element 45 denotes essentially a piezoelectric element or a magnetostrictive element. Nevertheless, it is quite obviously possible for any other material whose dimensions could be modulated under the effect of variation of a physical variable to be adopted.

In particularly advantageous manner, hollow stem 42 has mechanical elasticity such that its longitudinal deformation can take place in reversible manner.

The mechanical elasticity involved can be derived from the intrinsically elastic nature of the material of which hollow stem 42 is composed, and/or from a particular structure, such as an open-worked structure, of the said hollow stem 42. This characteristic permits hollow stem 42 to offer a minimum of resistance to deformation during the phase of opening of poppet 41, while favoring return to the initial state during the closing phase, as soon as active element 45 is no longer energized. The fact that the elastic energy transmitted during deformation is restored on return makes it advantageously possible to dispense with specific restoring means, as is the case with the prior art injection devices.

According to another particular feature of the invention, rear element 46 has a density and rigidity much greater than those of the other elements of which protruding needle 40 is composed.

That means that rear element 46 is made of a particularly dense and hard material, so that, respectively, on the one hand it can constitute a true inertial mass and on the other hand not be deformed under the action of elongation of active element 45.

Thus, as can also be seen in FIG. 1, injection device 1 is additionally equipped with prestressing means 70, which are capable of permanently compressing internal bar 44 against solid end 43 of hollow stem 42.

The purpose is quite obviously to impose compression indirectly on active element 45, in order to optimize its capacities, especially in terms of elongation and responsiveness. Regardless of whether such an active element 45 is composed of a piezoelectric or magnetostrictive material, it is known that it is imperative that it be prestressed in order that it can be used effectively. In fact, materials of this type have greater difficulty in withstanding elongations than compressions, and so, to ensure that they are not in this state at any moment, it is indispensable to provide means capable of permanently exerting a compressive force on active element 45, even when the latter is in an elongation phase. This characteristic also makes it possible to preserve material whose resistance to expansion is relatively low, substantially by a factor of ten compared with its compression resistance.

In the example of FIG. 1, prestressing means 70 comprise a compression spring 71, which acts axially on the apparent cross section 48 of internal bar 44.

According to another particular feature of the invention, injection device 1 is equipped with interlocking means 80, which have two functions. The first consists in permitting immobilization of protruding needle 40 relative to the body of injection device 1 when the said protruding needle 40 is subjected to a force whose intensity is below a given threshold. This first characteristic advantageously makes it possible to neutralize low-intensity and/or point forces, such as vibrations.

The second function of interlocking means 80 is to permit protruding needle 40 nevertheless to move translationally relative to the body of injection device 1, as soon as the intensity of an applied force exceeds the threshold alluded to in the foregoing. This second characteristic makes it possible to absorb more intense and/or continuous forces, such as those resulting from thermal expansions of internal components of injection device 1, and especially of protruding needle 41.

In the particular embodiment of FIG. 1, interlocking means 80 first comprise three external grooves 82, which are arranged parallel to one another on the surface of a tubular element 81, forming a shoulder. This tubular element 81 is itself interlocked rigidly around protruding needle 40, but in removable manner, by the intermediary of a reversible mounting means composed in the present case of a traditional cooperation between two complementary screw threads. In addition, each external groove 82 extends in a plane orthogonal to the axis of protruding needle 40. Interlocking means 80 are additionally provided with a helicoidal groove 83, which is arranged in the interior of the body of injection device 1. Finally, interlocking means 80 are provided with a ball 84 for each external groove 82. In addition, the assembly is arranged in such a way that each ball 84 is able to cooperate, by partial insertion, with the corresponding external groove 82, into which substantially one half fits, and with helicoidal groove 83, into which substantially the other half fits. Specifically, balls 84 are positioned at the points of intersection between helicoidal groove 83 and external grooves 82.

It is particularly advantageous for the three balls 84 to be distributed in equidistant manner, at 120° from one another in the present case. In this way, they can fully perform the function of centering means for tubular element 81 and consequently for protruding stem 40.

According to one characteristic of this particular embodiment, the depth of each external groove 82 is substantially greater than the radius of the corresponding ball 84, whereas that of helicoidal groove 83 corresponds substantially to the radius of each ball 84. In addition, each external groove 82 is provided with a compression means 85 capable of pushing corresponding ball 84 to the bottom of helicoidal groove 83.

Thus each ball 84 is positioned with one half in helicoidal groove 83 on the one hand, and with the other half in corresponding external groove 82 on the other hand. This characteristic allows the mechanical stresses at the level of each connection point manifested by each assembly comprising ball 84, external groove 82 and helicoidal groove 83 to be distributed equitably.

Be that as it may, when an external force of sufficient intensity is applied to protruding needle 40, the resulting displacement remains relatively limited. In fact, since on the one hand the only mobility permitted is the combination of a rotation and an axial translation, and since on the other hand the pitch of helicoidal groove 83 is relatively small, the system can respond only with low amplitudes and a very long time constant. This advantageous characteristic permits in particular tension-applying means 90, which will be described hereinafter, to fully exert their function and also to compensate for the variations in length due to thermal expansions.

As FIG. 1 shows, it is to be noted that in this practical example the upper part of tubular element 81 is integral with a disk 87, which advantageously constitutes a stop for compression spring 71 of prestressing means 70.

According to another particular feature of the invention, injection device 1 is provided with tension-applying means 90, which are capable of maintaining poppet 41 of protruding needle 40 braced against its seat 15.

In this practical example, tension-applying means 90 are provided with a compression spring 91, which is disposed axially around protruding needle 40. Positioned in this way, compression spring 91 is capable of cooperating by contact with a part 86, forming a shoulder, of tubular element 81 on the one hand, and with a part 22, forming a stop, of the body of the injection device on the other hand.

Figure 2:
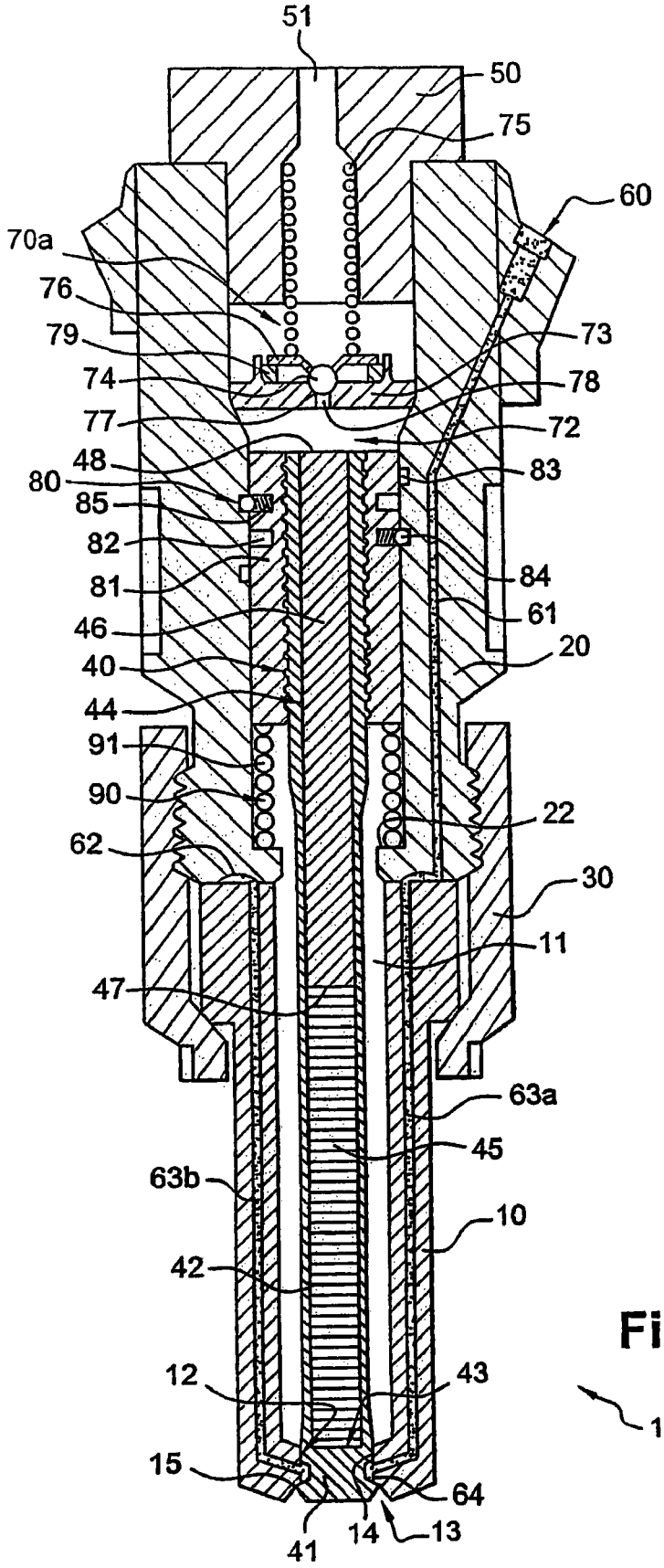
FIG. 2 constitutes an alternative version of the first embodiment of FIG. 1.

FIG. 2 illustrates an alternative version of the first embodiment described in the foregoing, which differs solely by the nature of the prestressing means 70*a* employed. In this case these means use pressurized liquid 72, which acts axially on the apparent cross section of internal bar 44, as well as a regulating poppet 73, which is capable of limiting the internal pressure of liquid 72 to a specified value.

In this particular embodiment, regulating poppet 73 is traditionally composed of a ball 74 which, under the action of a compression spring 75, and via an intermediate washer 76, is braced against a seat 77 defining an escape duct 78. In addition, there is to be noted the presence of an elastic ring at the interface between intermediate washer 76 and the body of regulating poppet 73.

Since the functioning of such a system is fully known, it will not be described further here. It will be stipulated simply that the purpose of regulating poppet 73 is to control the overpressure of the liquid present in the interior of injection device 1, and more precisely to fix the said pressure at a predefined value corresponding to the level of prestress that it is desired to apply to active material 45.

It will also be specified that the presence of pressurized liquid 72 in the interior of injection device 1 results in this case directly from the recirculation phenomenon established to cool the internal components. But of course an independent high-pressure liquid system could very well be adopted as an alternative.

In the first embodiment of FIGS. 1 and 2, protruding needle 40 includes a piezoelectric active element 45, whose length can be increased under the effect of an electric field. In addition, the elongation of piezoelectric active element 45 is capable of longitudinally deforming that external part of protruding needle 40 which surrounds the said piezoelectric active element 45.

Figure 3:
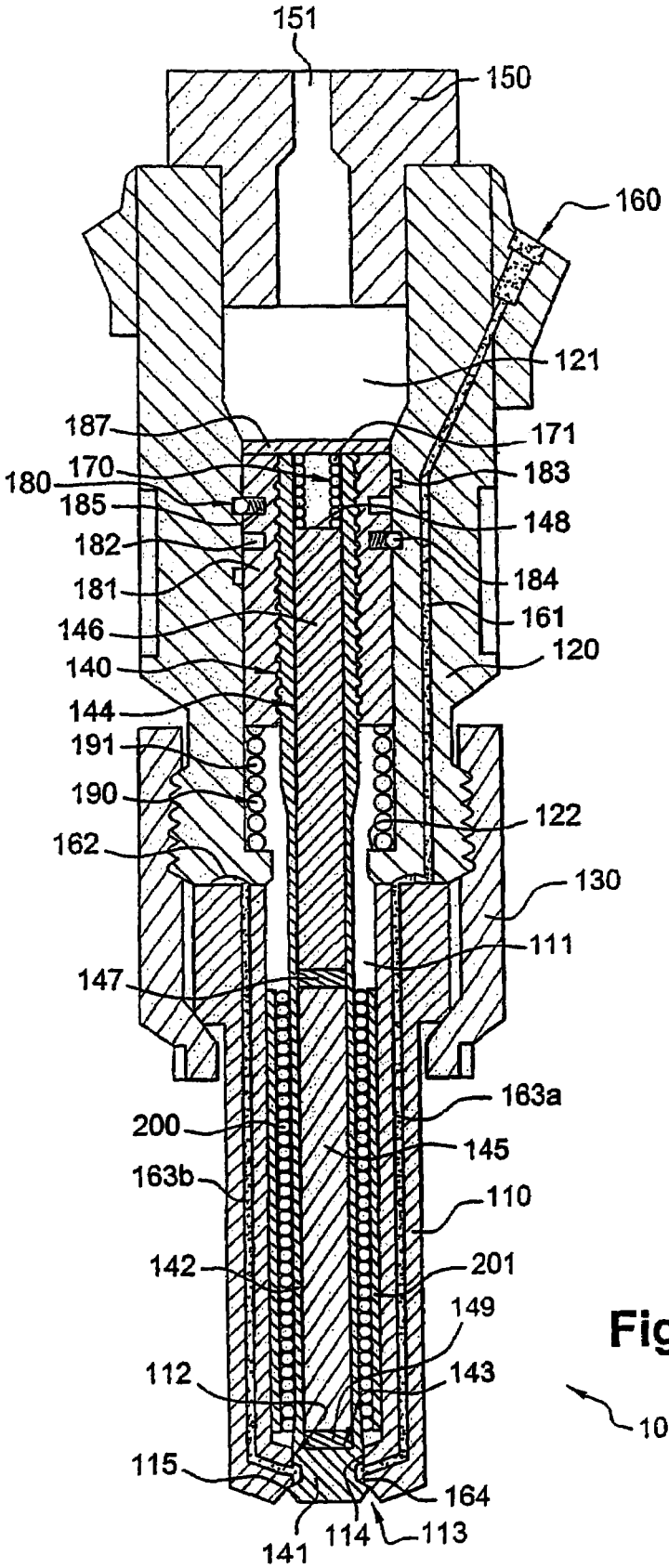
FIG. 3 represents a fluid-injection device according to a second embodiment of the invention.

However, and according to the second embodiment illustrated in FIG. 3, an injection device 100 can be equipped with a protruding needle 140 that includes a magnetostrictive active element 145, whose length can be increased under the effect of, in this case, a magnetic field. The assembly here is again arranged in such a way that the elongation of magnetostrictive active element 145 is of such nature as to longitudinally deform that external part of protruding needle 140 which surrounds the said magnetostrictive active element 145.

In practice, and as can be seen in FIG. 3, it is then appropriate to provide, as is traditional, the presence of a solenoid 200 and of a tube 201 of magnetic material disposed axially inside injection device 100. Specifically, magnetic tube 201 is positioned concentrically around solenoid 200, which is itself positioned concentrically around magnetostrictive element 145.

According to a particular feature of this second embodiment, when active element 145 is magnetostrictive, it is advantageous to choose an amagnetic material for rear element 146. Protruding needle 140 is then provided in addition with two intermediate elements 147, 149, which are positioned respectively between rear element 146 and active element 145 on the one hand, and between active element 145 and solid end 143 of hollow stem 142 on the other hand. In addition, each intermediate element 147, 149 is made of a magnetic material capable of causing the lines of the magnetic field used to excite active element 145 to form a closed loop.

It is to be noted that, by analogy with these intermediate elements 147, 149, the function of magnetic tube 201 is also to cause the lines of the magnetic field generated to bring about elongation of active element 145 to form a closed loop.

Prestressing means 170 of this second embodiment are identical to those of the first embodiment, as described in connection with FIG. 1. However, the alternative version of the first embodiment, or in other words the one using pressurized fluid, quite obviously could be easily adapted to injection device 100 of this second embodiment.

Of course, the invention also relates to any motor vehicle equipped with at least one injection means such as described hereinabove.

The invention claimed is:

1. A fluid-injection device comprising:

a protruding needle including a first one end, forming a poppet configured to be displaced between a closed position, in which the poppet blocks an aperture configured for ejection of a fluid, and an open position, in which the poppet is positioned at a controlled distance from the aperture, wherein the first one end of the protruding needle is hollow, and displacement of the poppet between its closed position and its open position is generated by an intrinsic elongation generated by an elongatable member, controlled at every instant, located in the hollow first one end of the protruding needle.

2. An injection device according to claim 1, wherein the intrinsic elongation of the protruding needle takes place up to the direct vicinity of the poppet.

3. An injection device according to claim 1, wherein the protruding needle includes a piezoelectric active element, whose length is configured to be increased under effect of an electrical field, and wherein elongation of the piezoelectric active element is configured to longitudinally deform the protruding needle containing the piezoelectric active element.

4. An injection device according to claim 1, wherein the protruding needle includes a magnetostrictive active element, whose length is configured to be increased under effect of a magnetic field, and wherein elongation of the magnetostrictive active element is configured to longitudinally deform the protruding needle containing the magnetostrictive active element.

5. A fluid-injection device comprising:

a protruding needle including a first one end, forming a poppet configured to be displaced between a closed position, in which the poppet blocks an aperture configured for ejection of a fluid, and an open position, in which the poppet is positioned at a controlled distance from the aperture, wherein displacement of the poppet between its closed position and its open position is generated by an intrinsic elongation, controlled at every instant, of the protruding needle, and the protruding needle includes a hollow stem having a solid end that forms the poppet, and an internal bar composed of an active element integral with a rear element, forming an inertial mass, and wherein the internal bar is mounted to be mobile axially inside the hollow stem and is interlocked with the solid end of the hollow stem via the active element.

6. An injection device according to claim 5, wherein the stem has mechanical elasticity such that its longitudinal deformation can take place in a reversible manner.

7. An injection device according to claim 5, wherein the rear element has a density and rigidity substantially greater than those of other elements of which the protruding needle is composed.

8. An injection device according to claim 5, wherein the active element is magnetostrictive, the rear element is amagnetic, and the protruding needle further includes two intermediate elements, positioned respectively between the rear element and the active element, and between the active element and the solid end of the hollow stem each intermediate element is made of a magnetic material configured to cause lines of the magnetic field used to excite the active element to form a closed loop.

9. An injection device according to claim 5, further comprising prestressing means, for permanently compressing the internal bar against the solid end of the hollow stem.

10. An injection device according to claim 9, wherein the prestressing means comprises a compression spring, which acts axially on the apparent cross section of the internal bar.

11. An injection device according to claim 9, wherein the prestressing means comprises a pressurized fluid, which acts axially on the apparent cross section of the internal bar, and a regulating poppet, for limiting internal pressure of the fluid to a specified value.

12. An injection device according to claim 1, further comprising interlocking means for permitting immobilization of the protruding needle relative to a body of the injection device when the protruding needle is subjected to a force whose intensity is below a predetermined threshold, and for permitting translational movement of the protruding needle relative to the body of the injection device, as soon as intensity of an applied force exceeds the predetermined threshold.

13. A fluid-injection device comprising:

a protruding needle including a first one end, forming a poppet configured to be displaced between a closed position, in which the poppet blocks an aperture configured for ejection of a fluid, and an open position, in which the poppet is positioned at a controlled distance from the aperture; and interlocking means for permitting immobilization of the protruding needle relative to a body of the injection device when the protruding needle is subjected to a force whose intensity is below a predetermined threshold, and for permitting translational movement of the protruding needle relative to the body of the injection device, as soon as intensity of an applied force exceeds the predetermined threshold, wherein the interlocking means includes at least three external grooves, arranged parallel to one another on a surface of a tubular element, forming a shoulder, which itself is interlocked rigidly around the protruding needle, but in a removable manner, each external groove extending in a plane orthogonal to the axis of the protruding needle, a helicoidal groove arranged in an interior of the body of the injection device, and a ball for each external groove, each ball configured to cooperate, by partial insertion, with the corresponding external groove, into which substantially one half fits, and with the helicoidal groove, into which substantially the other half fits, and wherein displacement of the poppet between its closed position and its open position is generated by an intrinsic elongation, controlled at every instant, of the protruding needle.

14. An injection device according to claim 13, wherein a depth of each external groove is substantially greater than a radius of the corresponding ball, wherein a depth of the helicoidal groove corresponds substantially to the radius of each ball, and wherein each external groove includes compression means for pushing the corresponding ball to the bottom of the helicoidal groove.

15. An injection device according to claim 1, further comprising tension-applying means for maintaining the poppet of the protruding needle braced against a respective seat.

16. A fluid-injection device comprising:

a protruding needle including a first one end, forming a poppet configured to be displaced between a closed position, in which the poppet blocks an aperture configured for ejection of a fluid, and an open position, in which the poppet is positioned at a controlled distance from the aperture; and tension-applying means for maintaining the poppet of the protruding needle braced against a respective seat, wherein displacement of the poppet between its closed position and its open position is generated by an intrinsic elongation, controlled at every instant, of the protruding needle, and the tension-applying means includes a compression spring disposed axially around the protruding needle and which cooperates by contact with a part, forming a shoulder, of a tubular element, and with a part, forming a stop, of a body of the injection device.

17. A motor vehicle, comprising:

at least one injection device comprising:

a protruding needle including a first one end, forming a poppet configured to be displaced between a closed position, in which the poppet blocks an aperture configured for ejection of a fluid, and an open position, in which the poppet is positioned at a controlled distance from the aperture, wherein the first one end of the protruding needle is hollow, and displacement of the poppet between its closed position and its open position is generated by an intrinsic elongation generated by an elongatable member, controlled at every instant, located in the hollow first one end of the protruding needle.

* * * * *